United States Patent [19]

Kosuda et al.

[11] 4,452,187

[45] Jun. 5, 1984

[54] HYDRAULIC VALVE LIFT DEVICE

[75] Inventors: Toru Kosuda; Yasuhiro Takeuchi, both of Okazaki; Noboru Matsubara, Susono; Masaaki Takizawa, Mishima, all of Japan

[73] Assignees: Nippon Soken, Inc., Nishio; Toyota Jidosha Kogyo Kabushiki Kaisha, Toyota, both of Japan

[21] Appl. No.: 474,055

[22] Filed: Mar. 10, 1983

Related U.S. Application Data

[62] Division of Ser. No. 178,285, Aug. 15, 1980, Pat. No. 4,408,580.

[30] Foreign Application Priority Data

Aug. 24, 1979 [JP] Japan ..... 54-108471
Aug. 28, 1979 [JP] Japan ..... 54-109510

[51] Int. Cl.[3] ..... F01L 1/34
[52] U.S. Cl. ..... 123/90.16; 123/90.55
[58] Field of Search ..... 123/90.16, 90.55, 90.56, 123/90.57, 90.58, 90.59, 90.46

[56] References Cited

U.S. PATENT DOCUMENTS 3,439,661 4/1969 Weiler ..... 123/90.16
3,490,423 1/1970 Shunta et al. ..... 123/90.55
3,518,976 7/1970 Thuesen ..... 123/90.16
3,817,228 6/1974 Bywater ..... 123/90.16
4,258,671 3/1981 Takizawa et al. ..... 123/90.16
4,347,812 9/1982 Kosuda et al. ..... 123/90.16

*Primary Examiner*—Craig R. Feinberg
*Assistant Examiner*—W. R. Wolfe
*Attorney, Agent, or Firm*—Cushman, Darby & Cushman

[57] ABSTRACT

A hydraulic valve lift device for internal combustion engines includes a lifter having therein an oil pressure chamber for introduction of oil and slidably disposed in a cylindrical bore of a housing with one end thereof engaged by a cam or a cam shaft, and a plunger slidably disposed in the lifter for opening and closing an intake or exhaust valve of which a valve lift is variable depending upon the rotational speed of the cam by discharging oil from the oil pressure chamber through a throttling port. A braking chamber is defined by a flange portion of the plunger and the cylindrical bore, and is communicated through a slit with a oil feed chamber adapted to allow oil to flow thereinto. A relief valve is provided for communicating with the braking chamber to control its oil pressure below a set value. A control device is provided for controlling the relief valve depending upon an output of a detector such that the set force of the valve corresponds with a desired value.

4 Claims, 6 Drawing Figures

HYDRAULIC VALVE LIFT DEVICE

This is a division of application Ser. No. 178,285, filed Aug. 15, 1980, now U.S. Pat. No. 4,408,580.

BACKGROUND OF THE INVENTION

The present invention relates to a hydraulic valve lift device for an internal combustion engine and, more particularly, to a hydraulic valve lift device adapted for relaxing impacts at the time of seating of the valve.

There have been proposed various types of valve lift devices for varying the valve lift timing in accordance with load imposed on the engine or running speed of the engine. In one of these known devices, which is basically identical to a known hydraulic tappet device, the oil in an oil chamber pressurized by a plunger engaging a push rod and by a lifter body is allowed to be relieved to the outside through a restriction or orifice so as to reduce the volume of the oil chamber, thereby changing the lift of the plunger.

In this type of valve lift device, the cam contour is of two dimensions, and it is not necessary to change relative positions of the cam shaft and the plunger to each other, so that the construction of the device is considerably simple. However, since the device is constructed in such a manner as to vary the valve lift by relieving the oil from the oil chamber, it is impossible to make the cam have such a cam contour involving a curvature for reducing the moving velocities of the intake and exhaust valves at the instant of seating as in cams conventionally used in engines. Therefore, a substantially large impact load acts on the valve at the time of seating to generate a large noise, thereby causing disadvantages in terms of durability of the valve mechanism.

To solve these problems, U.S. patent application Ser. No. 34,186, assigned to the applicant of this application, discloses a hydraulic valve lift device which comprises a braking chamber defined by a flange portion formed on a plunger and the cylindrical bore of a housing, said braking chamber being adapted to be supplied with oil through a slit during upward stroke of the plunger, said slit being adapted to be decreased in its opened area during downward stroke of the plunger to reduce an amount of oil relieved from the braking chamber, so that hydraulic pressure thus increased in the braking chamber exerts a braking force on the plunger, to absorb an impact load at the time of seating of the intake or exhaust valve.

With the device of the above U.S. Patent Application, however, the action of a braking force is not always stable under the influence of the operating condition of the engine (for example, changes in oil temperature, running speed and so on).

SUMMARY OF THE INVENTION

It is an object of the invention to eliminate these disadvantages in prior hydraulic valve lift devices.

It is another object of the invention to provide a hydraulic valve lift device capable of advantageously absorbing impact loads produced at the time of valve seating, reducing noises and improving a durability of the valve mechanism.

It is still another object of the invention to provide a hydraulic valve lift device in which a valve lift is variable depending upon running speeds of the engine and in which a braking force acts smoothly and stably at the time of valve seating regardless of the operating conditions of the engine (for example, changes in oil temperature, running speeds and so on).

DESCRIPTION OF THE PREFERRED EMBODIMENT

Figure 1:
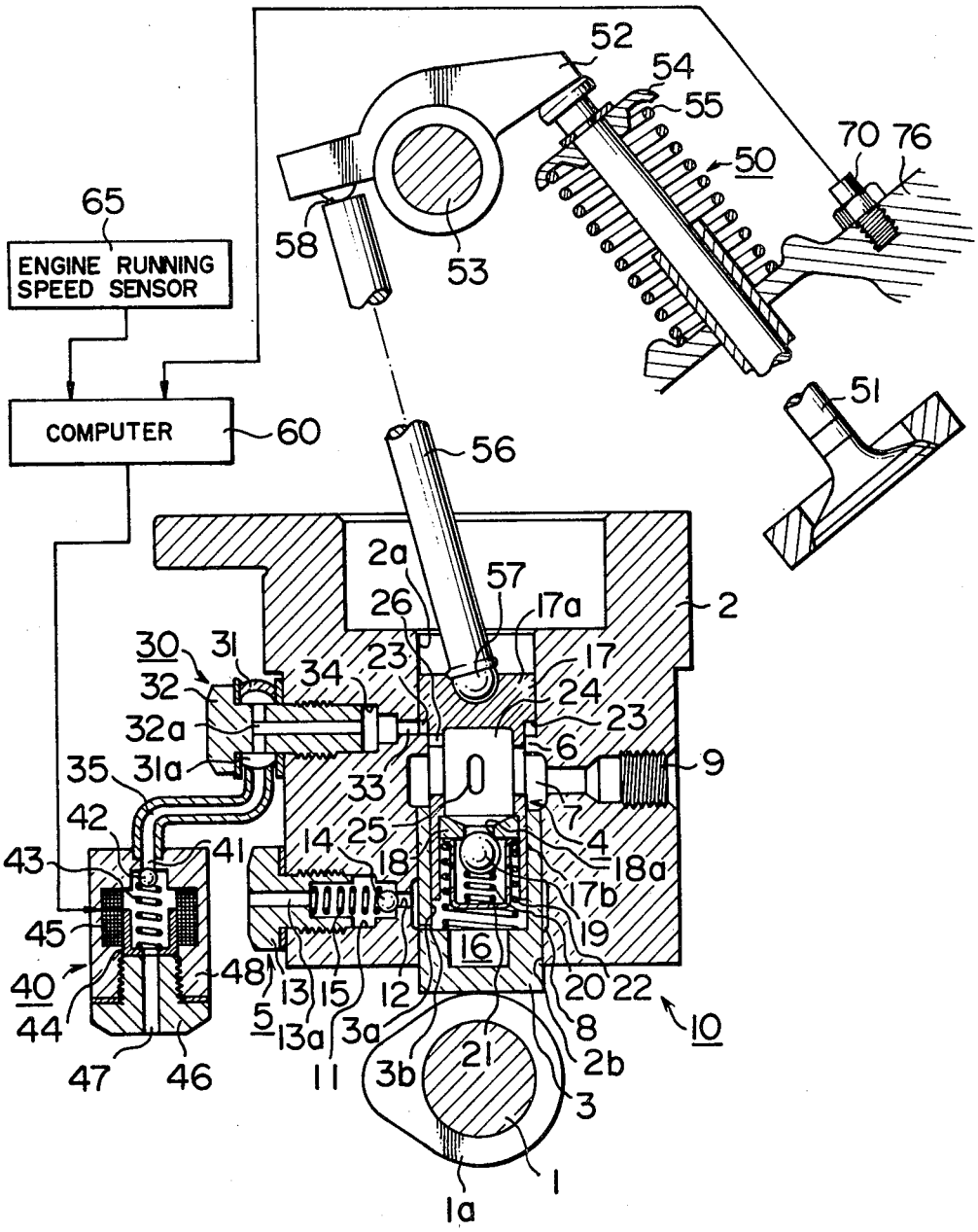
FIG. 1 is a sectional side elevational view of a hydraulic valve lift device of the invention mounted on an internal combustion engine.

Referring first to FIG. 1, a variable valve lift device according to an embodiment of the invention, generally designated at reference numeral 10, is interposed between a cam 1*a* on a cam shaft 1 and a valve device 50 of an OHV 4-stroke cycle engine, and is attached to the cylinder block (not shown) of the engine. The cam shaft 1 on which the cam 1*a* is mounted rotates in synchronism with the rotation of the crank shaft of the engine.

The variable valve lift device 10 has a housing 2 formed with upper and lower cylindrical bores 2*a*, 2*b*, a cylindrical lifter 3 slidably received in the lower cylindrical bore 2*b*, a plunger device 4 slidably received in a cylindrical bore 3*a* of the lifter 3.

The housing 2 is securedly mounted on a cylinder block (not shown) of the engine, and the lifter 3 has its end surface contacted with the cam 1*a* of the cam shaft 1.

As will be seen from FIG. 1, the upper and lower cylindrical bores 2*a*, 2*b* of the housing 2 are coaxial with each other, and are separated from each other by a shoulder 6 and an annular oil feed groove 7 formed on the lower cylindrical bore 2*b*. The lower cylindrical bore 2*b* is formed at its intermediate portion with an annular relief groove 8, and slidably accommodates the lifter 3 therein.

The housing 2 is formed with an oil inlet port 9 through which oil delivered by an oil pump (not shown) is introduced. The oil inlet port is in communication with an oil feed groove 7. At the lower portion of the housing 2 is formed a bore 11 for receiving the oil ejecting device 5 therein. The bore 11 is in communication with the oil relief groove 8 through an oil relief port 12.

The oil ejecting device 5 has a cap member 13 adapted to be screwed into the bore 11 of the housing 2, a check ball 14 adapted to be seated on the end of the oil relief port 12 and a coiled spring 15 disposed between the cap member 13 and the check ball 14 for biasing the check ball 14 against the port 12. The cap member 13 has a communication passage 13*a* which is communicated with the outside of the valve device, e.g. an oil chamber (not shown) of the cylinder block. The lifter 3 is formed therein with an oil pressure chamber 16 and a cylindrical guide bore 3*a* which oil pressure chambers is in communication with the relief groove 8 of the housing 2 through an orifice port 3*b*.

The plunger device 4 includes a plunger 17, a seat member 18 fixed to the inside of the plunger 17, a check ball 19 biased against the central bore 18*a* of the seat member 18 by a coiled spring 20, and a cup-shaped member 21 biased against the seat member 18 by a coiled spring 22. The coiled spring 22 is interposed between the shoulder of the cylindrical bore 3*a* of the lifter 3 and a flange of the cup-shaped member 21 to bias the cup-shaped member 21 against the seat member 18. The plunger 17 comprises a flange portion 17*a* slidably fitted in the upper cylindrical bore 2*a* of the housing 2, and a cylindrical portion 17*b* slidably fitted in the cylindrical bore 3*a* of the lifter 3. The flange portion 17*a* and cylindrical portion 17*b* cooperate with the upper cylindrical bore 2*a* of the housing 2 and the shoulder portion 6 to define an annular braking chamber 23.

The cylindrical portion 17*b* of the plunger 17 is provided therein with an oil feed chamber 24. The oil feed chamber 24 is maintained in communication with the oil feed groove 7 of the housing 2 by means of four oil feed ports 25 formed in the cylindrical portion 17*b* of the plunger 17.

The oil feed chamber 24 is separated from the oil pressure chamber 16 by the seat-member 18 and check ball 19.

Figure 2:
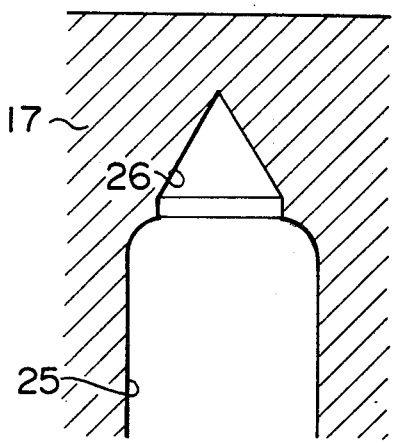
FIG. 2 is an enlarged view of an oil feed port and a slit formed on a plunger of the hydraulic valve lift device as shown in FIG. 1.

As will be seen from FIG. 2, one of the oil feed ports 25 is provided with a triangular slit 26 through which the oil feed chamber 24 is kept in communication with the braking chamber 23 during upward movement of the plunger 17. The area of the slit 26 opened to the braking chamber 23 is adjusted by means of the shoulder 6 of the housing 2 during upward and downward movements of the plunger 17. The intake valve device 50 includes a rocker arm swingably mounted on a rocker arm shaft 53, an intake valve 51 connected to the rocker arm by a valve rod, a valve spring retainer 54 mounted on the valve rod and a valve spring 55 disposed between the valve spring retainer 54 and a engine head 76 in surrounding relation with the valve rod. The rocker arm 52 is adapted to driven by a push rod 56 and drives the intake valve 51 (or an exhaust valve) to open and close the latter.

The flange portion 17*a* of the plunger 17 is formed with a generally hemispherical recess adapted to receive a connecting ball 57 integrally attached to one end of the push rod 56. Meanwhile, a connecting ball 58 at the other end of the push rod 56 is engaged by the rocker arm 52 so as to form a spherical connecting construction.

An oil collecting device 30 includes a cap member 32 screwed into an aperture 34 formed in the housing 2, and an oil collecting tube 31 surrounding the cap member 32. The threaded aperture 34 is in communication through an oil exhaust port 33 with the braking chamber 23, and a passage 32*a* formed in the cap member 32 is in communication with the oil exhaust port 33 and the interior of the oil collecting tube 31, respectively. The oil collecting tube 31 is connected through a conduit 35 with a relief valve 40.

The relief valve 40 comprises a casing 48 formed with an oil inlet port 41, and a cap portion 46 formed with an oil outlet port 47. The casing 48 receives therein a check ball 42, a compression spring 43 adapted to bias the check ball 42 against the oil inlet port 41, a retainer 44 holding the compression spring 43, and a coil 45 surrounding the retainer 44 to form therewith an electromagnetic solenoid. Thus the conduit 35 is communicated through the check ball 42 and oil outlet port 47 of the cap portion 46 with the outside, for example, an oil chamber (not shown) in the cylinder block. The oil of the relief valve 40 is electrically connected to a computer 60 which in turn is electrically connected to an engine running speed sensor 65 and a valve seating impact load sensor 70. Thus the computer 60 receives inputs from both sensors 65 and 70 and serves to vary the oil pressure in the braking chamber 23 by controlling the output to the coil 45 of the relief valve 40 such that the output of the valve seating impact load sensor 70 corresponds with a set value.

Figure 3:
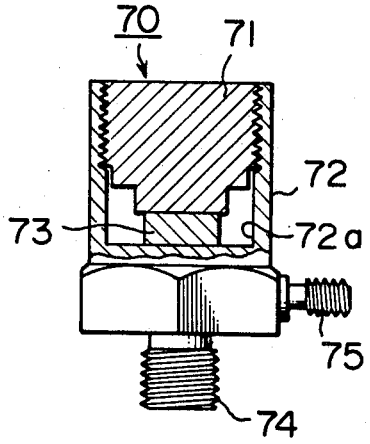
FIG. 3 is a partially sectional view of a detecting sensor of FIG. 1 for detecting a valve-seating impact load.

FIG. 3 shows the valve seating impact load sensor 70 in the section. An inertial mass member 71 is threadedly engaged by the interior of a casing 72 to compress a piezo-electric element 73. A lower portion 72*a* of the casing 72 and the element 73 act as a spring to form a resonant system together with the inertial mass member 71. The resonance of the system is designed to correspond with a frequency produced at the time of valve seating. The casing 72 is secured to the engine head 76 by a bolt 74, and the output of the sensor 70 is transmitted to the computer 60 via an output terminal 75.

Figure 4:
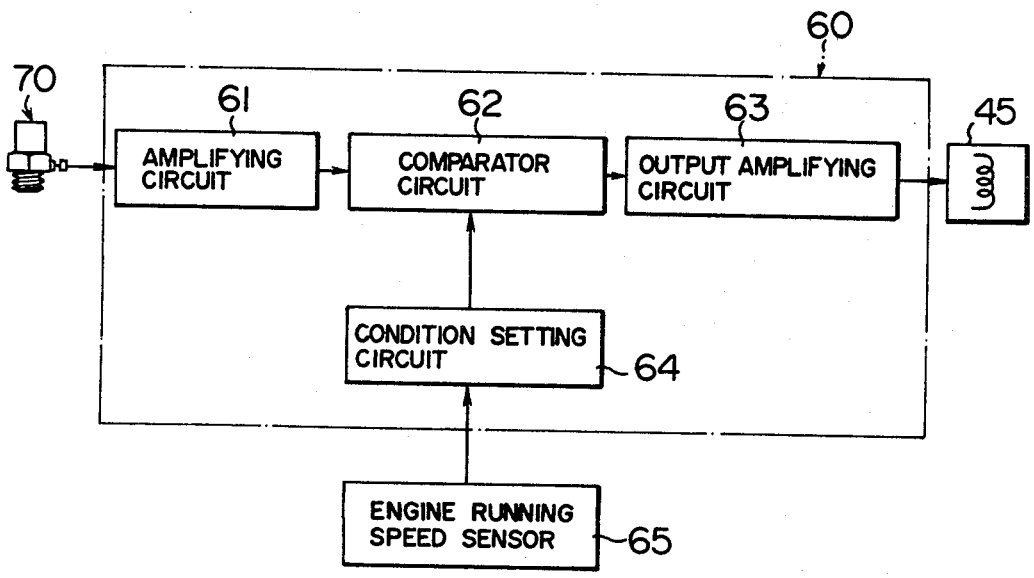
FIG. 4 is a block diagram of a computer as shown in FIG. 1.

Referring to FIG. 4, the computer 60 comprises an amplifying circuit 61 adapted to receive and amplify a signal from the valve seating impact load sensor 70, a comparator circuit 62, an output amplifying circuit 63 adapted to receive and amplify an output signal from the comparator circuit 62 and to transmit its output to the coil 45 of the relief valve 40, and a condition setting circuit 64 adapted to receive a signal representing the running speed of the engine from the sensor 65 and to determine a valve seating impact load. The comparator circuit 62 is adapted to compare the set value of seating impact load with the output of the amplifying circuit 61. The output of the output amplifying circuit 63 serves to control a set pressure of the relief valve 40 through the medium of the coil 45.

In operation, when the lifter 3 rests on the lowermost part of the cam contour of the cam 1*a*, the oil coming from the oil inlet port 9 is allowed to flow into the oil feed chamber 24 through the oil feed groove 7 and the oil feed port 25 of the plunger 17.

A part of the oil having come into the oil feed chamber 24 then flows into the braking chamber 23 through the variable restricting port defined by the slit 26 and the shoulder 6 of the housing. Meanwhile, a part of the oil in the oil feed chamber 24 acts on the check ball 19 to move it away from the central bore 18*a* of the seat member 18, and then flows into the oil pressure chamber 16 of the lifter 3.

The pressurized oil thus introduced into the oil feed chamber 24 and the oil pressure chamber 16 acts to bias the plunger 17 and lifter 3 away from each other. The oil having come into the oil pressure chamber 16 flows through the restriction port 3*b*, relief groove 8 and oil relief port 12 to push the check ball 14 away from the port 12, and then flows to the outside through the passage 13*a*.

Then, as the cam 1*a* starts to lift the lifter 3 due to the rotation of the cam shaft 1, the oil pressure in the oil pressure chamber 16 begins to be increased to push the check ball 19 against the central bore 18*a* of the sheet member 18. Consequently, the oil pressure in the oil pressure chamber 16 is increased to raise the plunger 17 against the force of the valve spring 55 which is transmitted through the push rod 56, thereby to open the intake valve 51 (or exhaust valve).

Meanwhile, the oil in the oil pressure chamber 16 continuously discharged to the outside through the restriction port 3b and relief groove 8 forcibly urges the check ball 14, so that the volume of the oil pressure chamber 16 is reduced gradually.

As the plunger 17 is moved upward in FIG. 1 due to a rise of pressure in the oil chamber 16, oil from the oil chamber 24 flows into the braking chamber 23 through the slit 26 and oil feed ports 25.

On the one hand, the check ball 42 is caused by the force of the compression spring 43 to close the oil inlet port 41, thereby preventing oil from flowing to the outside therethrough.

The oil in the oil pressure chamber 16 continuously flows to the outside through the restriction port 3b to gradually decrease the volume of the oil pressure chamber, so that the lift of the plunger 17 is reduced.

Namely, the lift of the plunger 17 is determined by the amount of oil discharged from the oil pressure chamber 16. When the rotational speed of the cam shaft 1 is low, the lift of the plunger 17 is made smaller. As the rotational speed of the cam shaft increases, the amount of oil discharged from the oil pressure chamber is gradually reduced to cause the lift to be determined depending on the cam contour of the cam 1a.

Since the volume of the oil pressure chamber 16, i.e. the lift of the plunger 17 is varied depending on the rotational speed of the cam shaft 1, the position where the cam 1a of the cam shaft 1 contacts with the lifter 3, when the plunger 17 is at the state before the lifter 3 starts to be lifted by the cam 1a, i.e. in the state in which the valve 51 (or exhaust valve) of the engine is closed, is changed in accordance with the speed of rotation of the cam shaft.

When the engine is operating at a low running speed, the oil in the braking chamber 23 flows into the oil feed chamber 24 through the slit 26 and oil feed ports 25, as the plunger 17 begins to move downward so as to reduce the volume of the braking chamber 23. As the plunger 17 is further lowered to make the oil feed ports 25 completely closed by the shoulder 6 formed in the housing 2, the slit 26 commences to restrict the flow of the oil from the braking chamber 23 to the oil feed chamber 24. As a result, the pressure in the braking chamber 23 is increased to act against the lowering of the plunger 17. As the plunger 17 is lowered, the opening area of the slit 26 through which the braking chamber 23 and oil feed chamber 24 are communicated is gradually restricted and reduced by the shoulder 6 of the housing, so that the discharge rate of the oil from the braking chamber 23 is gradually decreased increasing the pressure therein. This in turn increases the counter force acting against the lowering of the plunger 17.

When the oil pressure in the braking chamber 23 exceeds the set pressure of the relief valve 40, the oil in the braking chamber 23 is caused to be discharged to the outside through the oil outlet port 47. Therefore, the oil pressure in the braking chamber 23 can be prevented from becoming excessively high to the extent that excessive braking force is exerted to extraordinarily delay the timing of valve seating. However, the required set pressure in the relief valve 40 is varied under the influence of engine running speed or opening and closing speed of the intake valve 51 and viscosity of oil, so that the braking action becomes unstable. To cope with this phenomenon, the valve seating impact load sensor 70 is mounted on the engine head 76 to detect only a valve seating impact load of the intake valve 51.

On the one hand, the engine running speed sensor 65 serves to detect engine running speeds and to output these values to the condition setting circuit 64, in which circuit the value of valve seating impact load is determined dependent on the engine running speeds. The output of the valve seating impact load sensor 70 is amplified in the amplifying circuit 6 and then is compared in the comparator unit 62 with the set value from the condition setting circuit 64. When the difference between these values exceeds a predetermined limit, an output of the computer 60 is transmitted to the coil 45 of the relief valve 40 to control the set pressure of the valve. For example, braking is excessively performed when the set value is exceeded by that value which is obtained by amplifying the output of the valve seating impact load sensor 70. Thus the comparator circuit 62 acts on the relief valve 40 through the medium of the output amplifying circuit 63 and coil 45 of the electromagnetic solenoid such that the set pressure of the relief valve 40 becomes low so as to cause the valve seating impact load to correspond with the set value. When the value obtained by amplifying the output of the valve seating impact load sensor 70 exceeds a set value, the computer 60 controls the relief valve 40 such that the set pressure thereof becomes high. Thus a stable braking force can be applied at all times.

The lifter 3 is always maintained in pressure contact with the cam 1a of the cam shaft 1 by the action of the coiled spring 22 even when the plunger 17 is subjected to reaction forces in either of upward and downward directions by the push rod 56.

As the lifter 3 is lowered with the rotation of the cam shaft 1, the oil pressure in the oil pressure chamber 16 comes down below a predetermined level, so that the check ball 19 is moved away from the central bore 18a of the seat member 18 to allow oil to flow from the oil feed chamber 24 into the oil pressure chamber 16.

Figure 5:
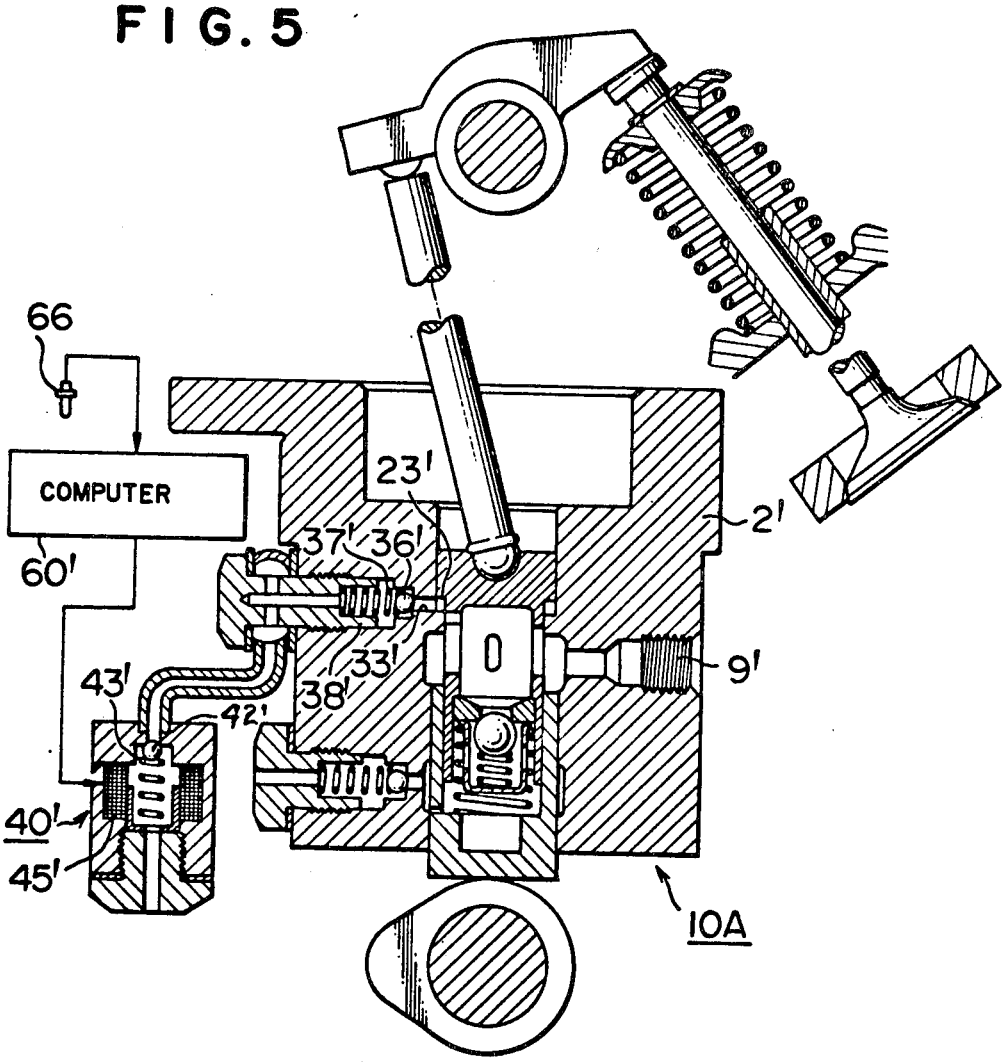
FIG. 5 is a sectional side elevational view of a hydraulic valve lift device mounted on an internal combustion engine and constructed in accordance with another embodiment of the invention.

FIG. 5 shows a variable valve lift device constructed in accordance with another embodiment of the invention, generally designated by numeral 10A. This valve lift device 10A differs from the valve lift device 10 of the previously described embodiment in the following points.

Referring to FIG. 5, a first relief valve 38' having a check ball 36' and a compression spring 37' is provided in association with a braking chamber 23' communicated to an oil discharge port 33'. The basic relief valve 38' serves to determine an oil pressure in the braking chamber 23', and a second relief valve 40' serves to compensate for the oil pressure of the braking chamber 23' depending upon oil temperatures. A set force of a compression spring 43' can be small to facilitate controlling the oil pressure of the braking chamber 23' depending upon the oil temperature.

An oil temperature sensor 66 is provided adjacent to an oil inlet port 9' of the housing 2' to output to a computer 60'. The computer 60' outputs to a coil 45' of the second relief valve 40' depending upon the output of the oil temperature sensor 66 to thereby control a set force of the compression spring 43'.

Figure 6:
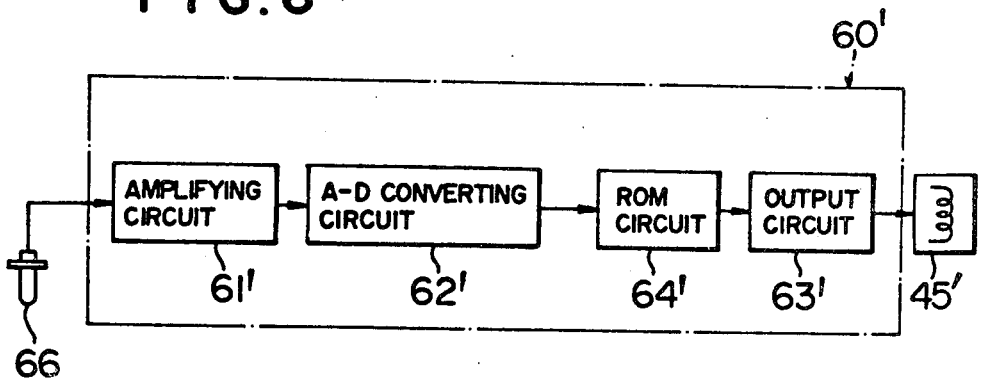
FIG. 6 is a block diagram of a computer as shown in FIG. 5.

FIG. 6 shows a block diagram of the computer 60' which comprises an amplifying circuit 61' for amplifying the output of the oil temperature sensor 66, an A-D converting circuit 62' for A-D converting the output of the amplifying circuit 61', a ROM circuit 64' for outputting a predetermined value depending upon the thus A-D converted output of the circuit 62', and an output circuit 63' for D-A converting and amplifying the output of ROM circuit. The output of the circuit 63' is input to the coil 45' which constitutes an electromagnetic solenoid of the relief valve 40'.

In operation, the viscosity of oil is greatly varied depending upon the oil temperature, so that oil pushing away the check ball 42' of the relief valve 40' is sharply changed in its flow resistance. Thus the oil pressure in the braking chamber 23' is greatly deviated from the set level. The computer 60' then controls its output to the coil 45' of the electromagnetic solenoid depending upon the output of the oil temperature sensor 66 to regulate the set force of the compression spring 43'. More specifically, the output of the oil temperature sensor 66 is input to the amplifying circuit 61' of the computer 60' to be amplified therein, and then to be subject to A-D conversion in the A-D converting circuit 62'. The resulting output of the circuit 62' is then input to the ROM circuit 64' in which the input is used to determine and output a value representing a set force of the compression spring 43' to the output circuit 63'. This output is subjected to D-A conversion and amplification in the output circuit 63' to control an electric current to the coil 45' constituting an electromagnetic solenoid. This control is performed in such a manner that the set force of the compression spring 43' becomes large when the oil temperature is high and the set force becomes small when the oil temperature is low. Thus the set pressure of the relief valve 40' is controlled depending upon oil temperatures to maintain the oil pressure of the braking chamber at a corresponding set value, so that a stable braking force can be constantly applied even if the oil temperature is varied to greatly change the viscosity of oil.

As stated above, there is provided a hydraulic valve lift device according to the present invention in which a valve lift can be varied depending upon engine running speeds and in which a braking force is applied at the time of valve seating by the oil pressure in the braking chamber to relieve impact loads. With the device of the present invention, a set pressure of a relief valve which sets the oil pressure in the braking chambers is controlled such that a detected value of a valve seating impact load detected by a valve seating impact load sensor mounted on the engine head is caused to correspond with a set value determined by the operating conditions of the engine.

Also, the set pressure of the relief valve is thus controlled depending upon the oil temperature, so that a smooth braking force can be applied over the range from low temperatures to high temperatures. Accordingly, the present invention can prevent any occurrence of undesirable phenomena, in which a braking force becomes too large at low oil temperatures to delay timings of valve seating or a braking force becomes too small at high oil temperatures with the result that an intake or exhaust valve strikes against a valve seat to generate large noises as well as to hasten timings of valve seating.

What is claimed is:

1. In a hydraulic valve lift device including a lifter having therein an oil pressure chamber for introduction of oil and slidably disposed in a cylindrical bore of a housing with its one end engaged by a cam on a cam shaft and a plunger slidably disposed in said lifter for opening and closing an intake or exhaust valve, of which a valve lift is made variable depending on the rotational speed of said cam due to discharge of oil from said oil pressure chamber through a throttling port, the improvement comprising a braking chamber defined by a flange portion of said plunger and said cylindrical bore, a slit adapted to communicate said braking chamber with an oil feed chamber of said plunger for flow-in of oil and to be reduced in its opening area depending upon the downward movement of said plunger, a relief valve provided in association with said braking chamber for controlling an oil pressure therein so as to cause it to be below a set value, a sensor for producing an electric signal representing a braking force generated by said braking chamber, an electromagnetic means for regulating a set working pressure of said relief valve, and a computer for energizing said electromagnetic means depending upon the output signal of said sensor to control said relief valve such that its set working pressure corresponds with a desired value, and wherein said computer comprises an amplifying circuit for amplifying a signal from said sensor, a condition setting circuit for setting a valve seating impact load depending upon running speeds of the engine, a comparator circuit for comparing the output of said amplifying circuit with the set value of said condition setting circuit and an output amplifying circuit for amplifying the output of said comparator circuit and outputting the resulting value to said electromagnetic means.

2. A hydraulic valve lift device as claimed in claim 1 wherein said sensor is mounted on a cylinder head of an internal combustion engine for detecting valve seating impact loads of the intake or exhaust valve to output a signal representing a braking force.

3. A hydraulic valve lift device as claimed in claim 1 wherein said sensor comprises a casing, an inertial mass body threaded into said casing and a piezo-electric element interposed and compressed between said casing and said inertial mass body, said casing being provided with a mounting bolt and an output terminal.

4. A hydraulic valve lift device in accordance with claim 1 including means for detecting a valve seating impact load of said intake or exhaust valve and means for controlling a set pressure of said relief valve such that the output of said detecting means corresponds with a set value which is determined by the operating conditions of the engine.

* * * * *